US010981035B2

(12) United States Patent
Marti

(10) Patent No.: US 10,981,035 B2
(45) Date of Patent: Apr. 20, 2021

(54) PORTABLE LOWER LIMB THERAPY DEVICE

(71) Applicant: Eduardo M Marti, Weston, FL (US)

(72) Inventor: Eduardo M Marti, Weston, FL (US)

( * ) Notice: Subject to any disclaimer, the term of this patent is extended or adjusted under 35 U.S.C. 154(b) by 142 days.

(21) Appl. No.: 16/130,953

(22) Filed: Sep. 13, 2018

(65) Prior Publication Data

US 2020/0086173 A1 Mar. 19, 2020

(51) Int. Cl.

| | |
|---|---|
| ***A63B 21/005*** | (2006.01) |
| ***A63B 21/012*** | (2006.01) |
| ***A61H 1/02*** | (2006.01) |
| ***A63B 21/00*** | (2006.01) |
| ***A63B 24/00*** | (2006.01) |

(52) U.S. Cl.

CPC ..... *A63B 24/0087* (2013.01); *A61H 1/0237* (2013.01); *A63B 21/0058* (2013.01); *A63B 21/00181* (2013.01); *A63B 21/012* (2013.01); *A61H 2201/164* (2013.01); *A61H 2201/165* (2013.01); *A61H 2201/5002* (2013.01); *A61H 2201/5007* (2013.01); *A61H 2205/106* (2013.01)

(58) Field of Classification Search

CPC ..... A63B 24/0087; A63B 21/0058; A63B 21/00181; A63B 21/012; A63B 2022/0094; A63B 2022/0097; A63B 2023/006; A63B 21/0004; A63B 21/00178; A63B 21/00185; A63B 21/02; A63B 21/04; A63B 21/0442; A63B 21/0552; A63B 21/0557; A63B 21/4013; A63B 21/4015; A63B 21/4034; A63B 21/4043; A63B 22/20; A63B 22/201; A63B 22/203; A63B 23/03508; A63B 23/0405; A61H 1/0237; A61H 2205/106; A61H 2201/5007; A61H 2201/165; A61H 2201/5002; A61H 2201/164

See application file for complete search history.

(56) References Cited

U.S. PATENT DOCUMENTS 3,713,437 A * 1/1973 Wiedmer ..... A61F 5/0116 601/27
5,509,870 A * 4/1996 Lloyd ..... A63B 69/0022 434/253

(Continued)

OTHER PUBLICATIONS

JAS Joint Active Systems; Knee Products; https://jointactivesystems.com/products/areas/knee/.

(Continued)

*Primary Examiner* — Sundhara M Ganesan
(74) *Attorney, Agent, or Firm* — The Keys Law Firm PLLC

(57) ABSTRACT

A portable lower limb therapy device having a support base and a pulley system. The support base includes a platform member fixably mounted on top of a slider and a heel panel positioned behind the platform member. The heel panel, which sits orthogonally relative to the platform member, is attached to the slider so as to extend from the rear end of the slider. The pulley system defines a closed force transfer system that is integrated with the support base. The pulley system employs a cord member, a support member, a cross member, and two handles and is configured to transfer force applied behind the heel panel to the platform member as well as force applied above a user's foot that is positioned on top of the platform member to the platform member.

16 Claims, 7 Drawing Sheets

(56) References Cited

U.S. PATENT DOCUMENTS 5,832,560 A * 11/1998 DePalma ..... A61F 13/041 16/30
6,551,221 B1 * 4/2003 Marco ..... A63B 21/0004 280/600
8,864,632 B2 * 10/2014 Johnson ..... A63B 21/0442 482/124
2005/0096201 A1 * 5/2005 Thelen ..... A63B 21/055 482/124
2006/0040807 A1 * 2/2006 Miller ..... A63B 21/0004 482/124
2008/0119765 A1 * 5/2008 Meckel ..... A61H 1/024 601/34
2012/0040808 A1 * 2/2012 Khademi ..... A61H 1/0285 482/124
2014/0180179 A1 * 6/2014 Cunningham ..... A63B 21/02 601/27
2015/0190668 A1 * 7/2015 Ferdinandsen, II . A63B 21/012 482/93
2015/0343261 A1 * 12/2015 Liptack ..... A63B 22/16 482/80
2016/0220862 A1 * 8/2016 Johnson ..... A63B 22/20
2019/0224523 A1 * 7/2019 Okubadejo ..... A63B 21/00061
2020/0061410 A1 * 2/2020 Hildebrandt ..... A63B 21/225

OTHER PUBLICATIONS

Lantz Medical; Stat-A-Dyne Knee; https://www.lantzmedical.com/stat-a-dyne-tm-knee.
Ortho Innovations; Mackie Knee Brace; http://www.orthoinnovations.com/mackieKnee.html.
The Medcom Group Ltd, Ezmend Knee Motion Device; https://www.medcomgroup.com/ezmend-knee-motion-device.
The Rehab Store, Sammons Preston Rigid Leg Lifter; https://www.rehab-store.com/p-sammons-preston-rigid-leg-lifter.html.

* cited by examiner

PORTABLE LOWER LIMB THERAPY DEVICE

BACKGROUND OF THE INVENTION

Field of the Invention

This invention relates to a portable therapy device which, when used by a user on a lower limb, allows the user to control the speed and direction of active and passive forces across a multitude of planes while performing rehabilitative activities on the lower limb.

Description of the Prior Art

Following acute lower limb injuries and/or surgery, it is common for patients to suffer from mechanical limitations in and around their joints. In order to help a patient regain strength and range of motion ("ROM") to the affected joints, patients are generally required to participate some form of therapy during the recovery process. Such therapy may involve attending clinician (e.g., physician, physical therapist) directed sessions at a clinic or medical facility. Unfortunately, often times therapy sessions are cut short prior to the completion of the recovery process. This can be due to a variety of reasons, such as limited treatment sessions approved by insurance companies, lack of transportation, inclement weather, illness, or inability to take days off from work to attend therapy sessions at the clinic.

In instances wherein therapy sessions are cut short, at-home adjunct devices may be used by a patient at home to optimize rehabilitation outcomes and to avoid scar tissue formation in order to eliminate the need for extended rehabilitation at a physical therapy ("PT") clinic or for manipulation under anesthesia ("MUA"). Indeed, it is well established that clinicians often prescribe the use of various rehabilitation (or rehab) devices to the injured patient to allow a patient to continue work to restore their health without having to attend frequent in-clinic therapy sessions. This practice has led to the development of many different types of devices designed to help augment rehabilitation efforts and patients that wish to continue to progress without the benefit of an in-clinic professional therapist, use these types of devices.

Adjunct at-home devices available today for knee and hip therapy cover a broad spectrum of options. Nonetheless, there are two types of motions that are viable, and typically, these devices generally only cover one or the other type of motion. The first type, passive motion, is a motion created by an outside force action on the persons limb/joint. The second type, active motion, is a motion in which the patient is supplying the force to move the affected limb on their own. In instances wherein a patient is working in-clinic with a clinician, the clinician typically provides both types of motions when they provide therapy to a patient. For example, the clinician can hold a patient's limb at a desired flexed position, and then asked the patient to activate their muscles to try to move their limb while the therapist resists (active resistance). A clinician may also slowly allow the patient to move the limb as the clinician adjusts the tension, allowing movement to occur (isotonic). A clinician may also allow the patient to move the limb by pushing as hard as they can while providing sufficient resistance to allow movement to occur at a set speed (isokinetic). A clinician may also have the patient push as hard as they can for 10 seconds then release the resistance and allow the patient to move to a different angle and repeat the same 10 second routine (isometric). A clinician can also have the patient try to lightly resist the motion the clinician provides as the clinician moves the limb through a range of motion (eccentric). In any event, the clinician is trained to evaluate the dynamics of movement that each patient exhibits and perform the best or combination of the best motion therapies that can improve joint function.

Attempts have been made to provide adjunct at-home devices which meet the needs of patients. Many of the devices for home use for ankles and knees are portable cycling devices. These devices have stands with foot pedals. The patient simply mimics riding a bicycle while sitting on a chair. Some of devices are motorized so that the patient can just relax and let the device rotate and move the limb. This type would be considered passive. The same bicycle type may have a resistance capability whereby a frictional force can make the patient provide more muscle power to turn the pedals, providing active resistance. This is also a type of isotonic motion.

Another class of devices is passive type equipment. Devices used after knee arthroscopic or knee implant surgery are known as continuous passive motion ("CPM") devices. These devices have electronic controllers that can be programmed to move the limb through a set ROM at a set speed and with a defined force level. These devices are rented by the day are generally utilized for about 14-21 days. Unfortunately, many insurance companies will not pay for a CPM device.

There are a several devices that provide a track with a sliding platform that allow the patient to flex and extend the leg using the track as a guided path and then by turning the track sideways, do hip abduction exercises. This type of device offers little or no resistance and its primary function is to keep joint mobility or maintain ROM between therapy sessions. The slider type device requires the patient to supply the energy to move the limb. This would be considered a low force active exerciser.

Other types of devices are the standard fitness-gym devices (e.g. leg extension machines) that use weights to provide resistance to the patient's limbs. These types of devices are external devices that are not used to rehabilitate the patients injured knee joint at home and they do not provide a feedback loop to the patient.

Another type of activity which may be employed during a recovery process is stretching. In many cases, clinicians may direct the utilization of mechanical stretching devices as part of a stretching program. Generally, mechanical stretching devices may be categorized as either dynamic low-load prolonged duration stretch devices ("LLPS") or static progressive ("SP") (i.e., splint) stretch devices. LLPS devices permit resisted active and passive motion (elastic traction) within a limited range. SP stretch devices hold the joint in a set position but allow for manual modification of the joint angle (inelastic traction).

In light of the normal therapy protocols that are implemented by a clinician, there remains a need for an adjunct at-home device that is able to facilitate the performance of rehabilitation exercises similar to those used by a clinician as they pertain to combined types of motions, active and passive, as well as those motions described as active resistive (isotonic), and active/rest/passive (contract relax therapy). There also remains a need for an adjunct at-home device that can provide for both dynamic and static progressive stretch therapy.

SUMMARY OF THE INVENTION

The present disclosure provides for a portable lower limb therapy device which can be used as an adjunct at-home device that can facilitate the performance of rehabilitation exercises employing combined types of motions, active and passive, motions described as active resistive (isotonic), and active/rest/passive (contract relax therapy), as well as provide for both dynamic and static progressive stretch therapy. The portable lower limb therapy device comprises: a support base having a platform member attached to and positioned above a slider, wherein the platform member is operative to support a foot of a user that is resting on the platform member and the slider includes a smooth bottom surface which enables the support base to slide in any direction when placed on a smooth surface; wherein the platform member is configured to be positioned in a flexed configuration in which at least a front edge of the platform member is elevated and a relaxed configuration in which the platform member is substantially planar; and a pulley system defined by a closed force transfer system integral with the support base, wherein said pulley system is configured to at least direct the platform member into the flexed configuration in response to the application of mechanical force in a location behind a rear edge of the platform member.

Embodiments of the portable lower limb therapy device may also include a cross member positioned above the platform member such that the cross member is above a foot of a user that is resting on the platform member, with the pulley system additionally configured to direct the platform member into the flexed configuration in response to the application of mechanical force to the cross member.

DETAILED DESCRIPTION OF THE INVENTION

Figure 1:
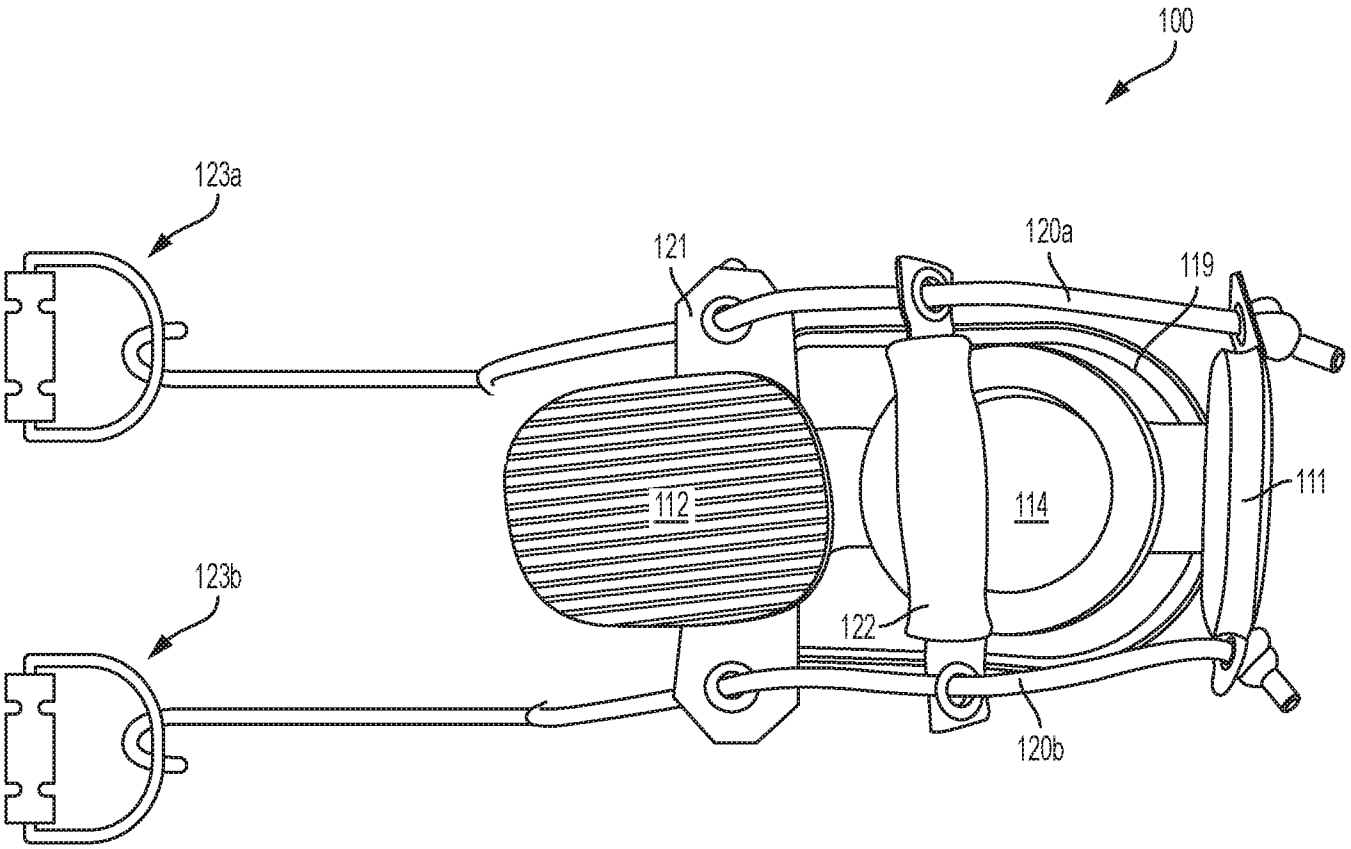
FIG. 1 is a top plan view of a portable lower limb therapy device built in accordance with a front handle embodiment of the present invention.

Referring now to the drawings and, in particular, FIGS. 1, 2, 3 and 4, a portable lower limb therapy device 100 built in accordance with a front handle embodiment is shown having a support base and a pulley system. The support base includes a slider 110 having a platform member 112 fixably mounted on top of it and a back panel 111 extending up from a location at or behind the proximal edge 113*a* (i.e., on the opposite side of the proximal edge 113*a* as the distal edge 113*b*). The support base has a proximal edge 113*a* and a distal edge 113*b*, which may be formed as the rear and front edges of the slider 110, respectively.

The slider 110 may define a rigid, slightly curved member having a smooth bottom surface that limits friction and allows it slide and glide when placed on other surfaces. The slider 110 may be constructed of hard plastic and the back panel 111, platform member 112, heel cup 114, and foot pad 114 may be constructed out of a substantially firm yet pliable foam.

Figure 3:
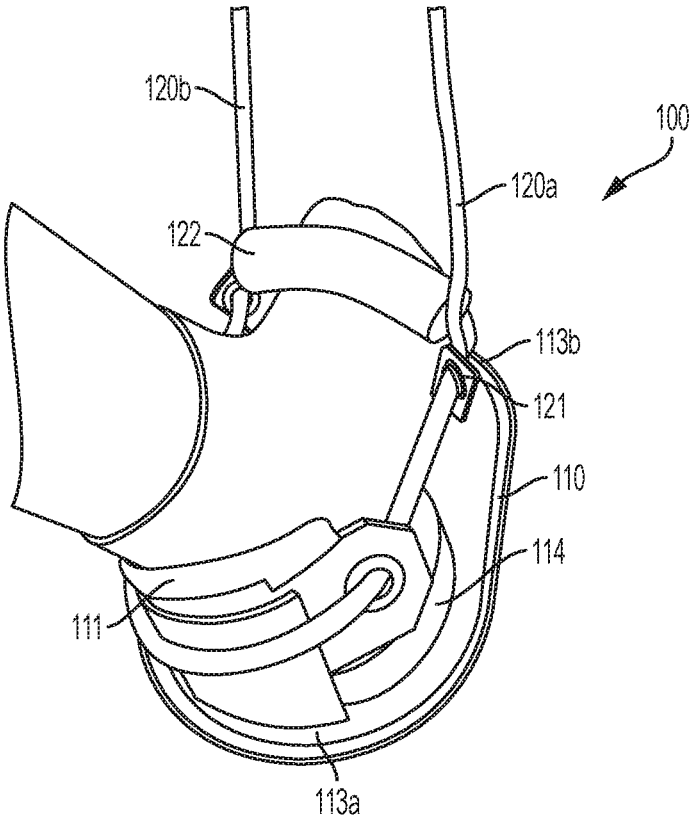
FIG. 3 is a side elevational view of a portable lower limb therapy device built in accordance with a front handle embodiment of the present invention, shown with a patient's foot in placed therein.

The platform member 112 may be defined by an elongated planar pad and is positioned adjacent to the distal edge 113*b*. The platform member 112, which may extend beyond the distal edge 113*b*, is movable relative to the slider 110 so as to be able to flex between an elevated position relative to the slider 110 and a planar position relative to the slider 110. It is appreciated that the platform member 112 being in the elevated position, forming a slope that rises as it moves away from the proximal edge 113*a*, defines the flexed configuration of the support base while the platform member 112 being in the planar position, sitting in horizontal alignment with the platform member 112, defines the relaxed configuration of the support base. It is further appreciated that the platform member 112 being in the elevated position enables the placement of a foot of a user in a therapeutic diagonal position relative to the slider 110, with the heel of the foot resting in the heel cup 114 and the foot extending up therefrom onto a substantially diagonally oriented platform member 112, as illustrated in FIG. 3.

The back panel 111 may be defined an planar pad and may be attached to and extend up from the slider 110.

The support base may additionally include a heel cup 114 positioned over the top surface of the slider 111 and adjacent to the proximal edge 113*b*. The heel cup 114 may be defined as a circular padded body having a raised perimeter edge and a depressed center portion. It is appreciated that the heel cup 114 configures the support base to be able to receive a heel of a user's foot and allow the heel to rest therein with the foot pointing towards the distal edge 113*b*.

In an alternate embodiment, the platform member 112 and heel cup 114 may be formed as a unitary body.

The pulley system. The pulley system defines a closed force transfer system and includes two cord members 120*a* 120*b*, a support member 121, a cross member 122, and two handles 123*a*, 123*b*, with a right handle 123*a* adjacent to the right side of the portable lower limb therapy device 100 and a left right handle 123*a* adjacent to the left side thereof. A right cord member 120*a* connects to and extends from the back panel 111 on the right side and a left cord member 120*b* connects to and extends from the back panel 111 on the left side. The right cord member 120*a* then passes through an aperture positioned on the right side of the cross member 122, then through an aperture positioned on the right side of the support member 121, finally connecting to the right handle 123*a*. The left cord member 120*b* then passes through an aperture positioned on the left side of the cross member 122, then through an aperture positioned on the left side of the support member 121, finally connecting to the left handle 123*b*. In this regard, the back panel 111 connects the two cord members 120*a*, 120*b* and allows force that is simultaneously applied to each of the handles 123*a*, 123*b* to act together to raise, lower, or otherwise manipulate the support base solely through the application of force on the handles.

The handles 123*a*, 123*b* may be constructed of or otherwise include foam. The handles 123*a*, 123*b* may be defined by a substantially cylindrical handle portion with a foam surface and a web type strap, with the web type strap connecting to the cord members 120*a*, 120*b* and to the handle portion to improve durability without sacrificing comfort.

The support member 121 defines a mechanical connector integrated with the foot pad 114, with a connection portion positioned on the right side of the foot pad 114 and a connection portion positioned on the left side of the foot pad 114. Each connection portion may include an aperture therein so as to configure it to allow the cord members 120*a*, 120*b* to pass through it.

The support member 121 may define a molded or web type strap that is attached to the underneath of the foot pad 114, above the platform member 112, with a portion extending beyond the foot pad 114 on both the right and left side so as to form the connection portions. The connection portions may include grommets integrated with the apertures therein. In an alternate embodiment, the support member 121 may be defined solely by two connection portions extending from either side of the foot pad 114.

The cross member 122 is positioned sufficiently above the heel cup 114 to allow the foot of a user that is placed on the platform member 112 with the heel in the heel cup 114 to slide underneath the cross member 122. The cross member 122 may be defined by a substantially cylindrical handle portion with a foam surface.

Each cord member 120*a*, 120*b* may define an elongated, continuous line that may be constructed of a rope, strap, tubing, or cable. The cord members 120*a*, 120*b* may be of an elastic material or a rigid material.

The back panel 111 may include grommets integral with the apertures through which the cord members 120*a*, 120*b* pass prior to be secured thereto.

It is contemplated that a user having their foot positioned in the may exert mechanical force on the lower limb therapy device 100 with their upper body (as passive motion) by grabbing either the handles 123*a*, 123*b* or the cross member 122. In this regard, the lower limb therapy device 100 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 100 is not on a track and can move in any direction, circumduction an available therapy motion option). Indeed, the pulley system enables a user to control the motion and the speed at which the lower limb moves as it is being flexed and extended thru various planes.

Moreover, because of the slider 110 can move on substantially any type of smooth surface, the lower limb therapy device 100 provides a means to support the weight of a user's lower limb and allow the limb to slide and glide even on uneven surfaces as a bed or therapy table.

Referring now to FIGS. 5, 6, 7, 8, 9 and 10, a portable lower limb therapy device 200 built in accordance with a back handle embodiment is shown having a support base and a pulley system. The support base includes a slider 210 having a platform member 212 fixably mounted on top of it and a heel panel 211 positioned behind the platform member 212 extending from it. The platform member 212 may include a proximal portion 212*a* and a distal portion 212*b*. The heel panel 211 may be attached to the slider 210 so as to extend from the rear end of the slider 210. The pulley system includes a cord member 220, a support member 221, a cross member 222, and two handles 223, with one of the handles adjacent to the right side of the portable lower limb therapy device 200 and the other adjacent to the left side thereof.

The slider 210 may define a rigid, slightly curved member having a smooth bottom surface that limits friction and allows it slide and glide when placed on other surfaces. The platform member 212 may define a planar member and may be attached to the slider 210 so as to be raised above the top surface of the slider 210, leaving a hollow space between the bottom surface of the platform member 212 and top surface of the slider 210. The platform member 212 additionally includes a central aperture. It is appreciated that the central aperture in the platform member 212, and the hollow space between the bottom surface of the platform member 212 and top surface of the slider 210, configure the platform member 212 to be able to receive a heel of a user's foot and allow the heel to rest therein with the foot pointing towards the distal portion 212*b*.

Figure 2:
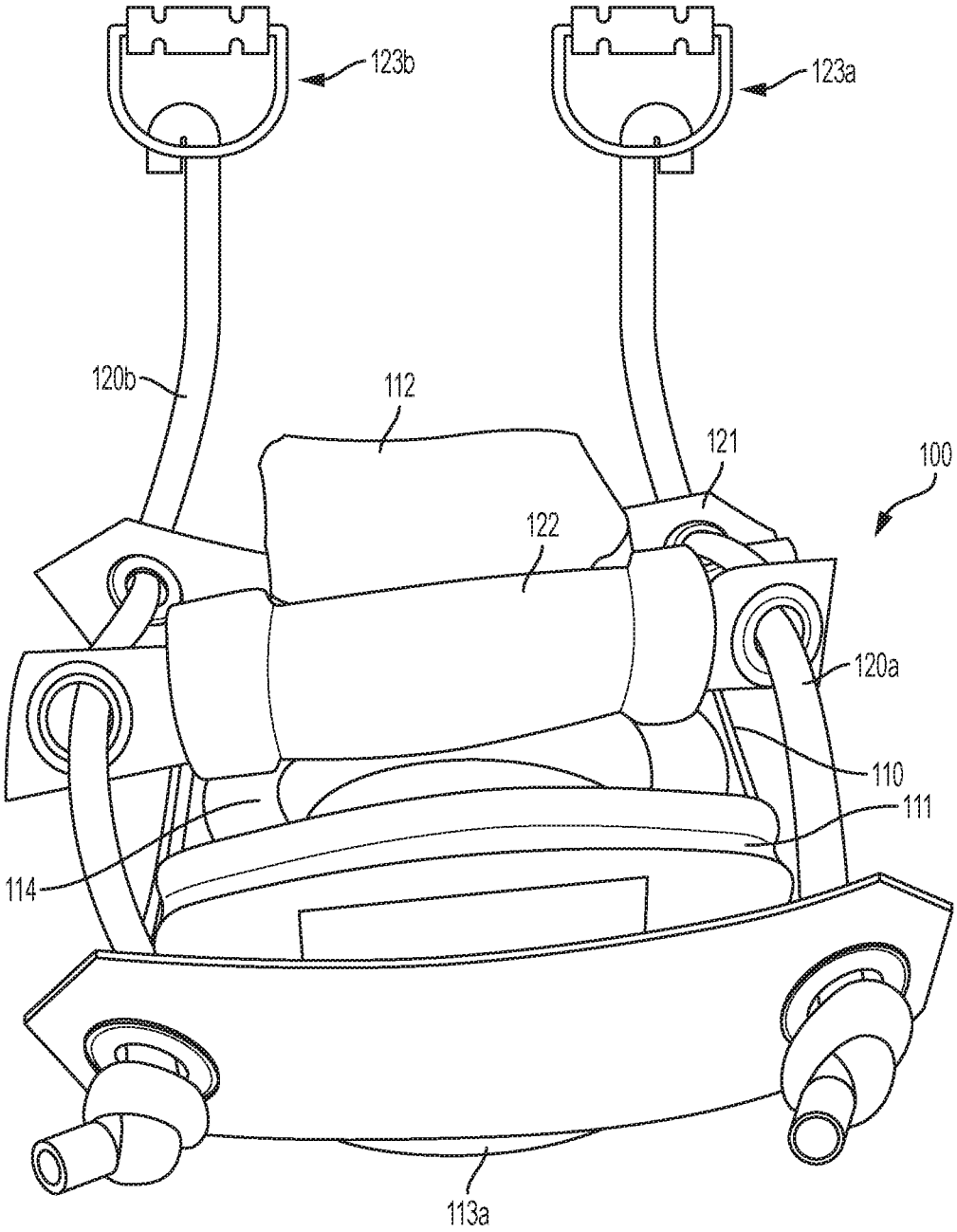
FIG. 2 is a rear perspective view of a portable lower limb therapy device built in accordance with a front handle embodiment of the present invention.
Figure 4:
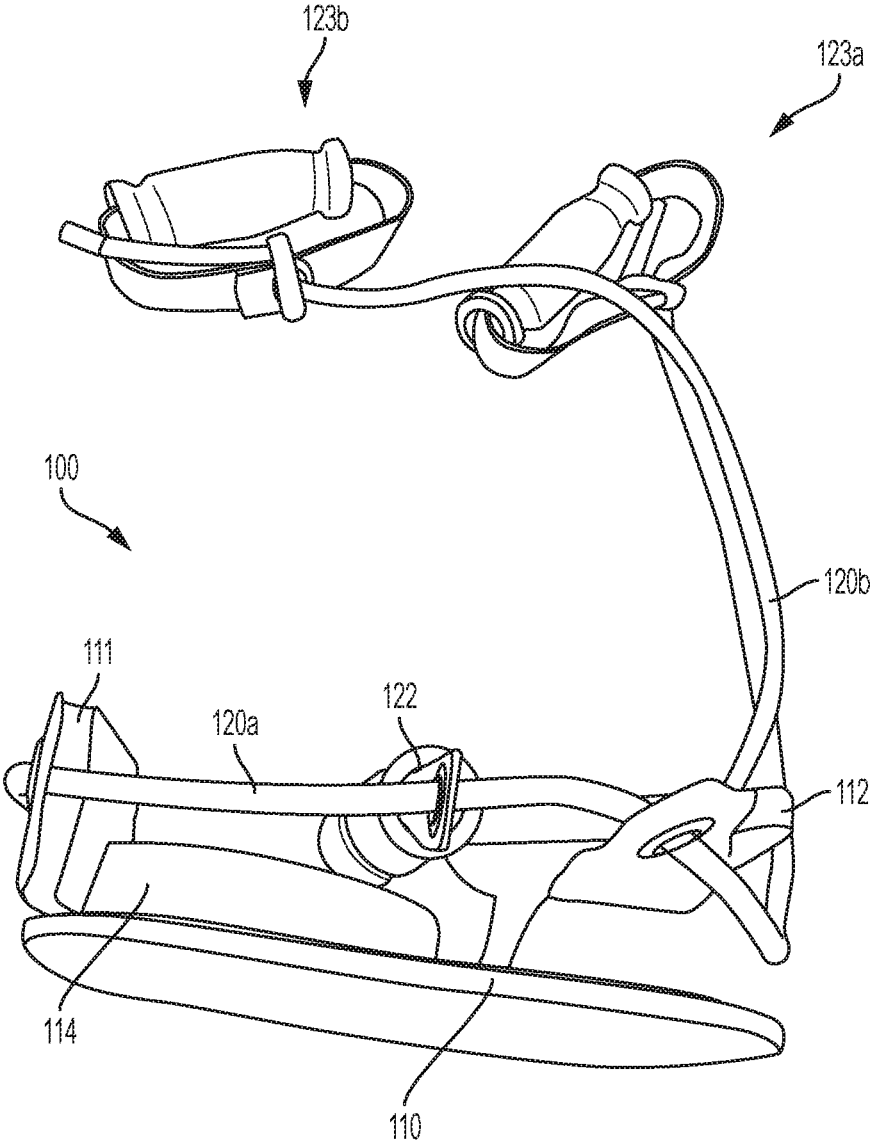
FIG. 4 is a side perspective view of a portable lower limb therapy device built in accordance with a front handle embodiment of the present invention.
Figure 5:
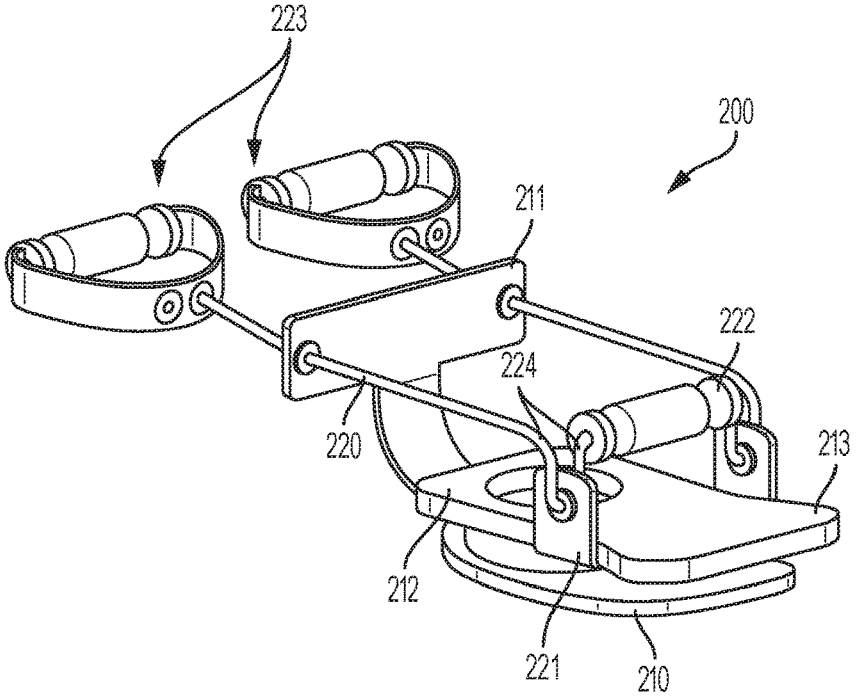
FIG. 5 is a top plan view of a portable lower limb therapy device built in accordance with a back handle embodiment of the present invention with a platform member in a relaxed configuration.
Figure 6:
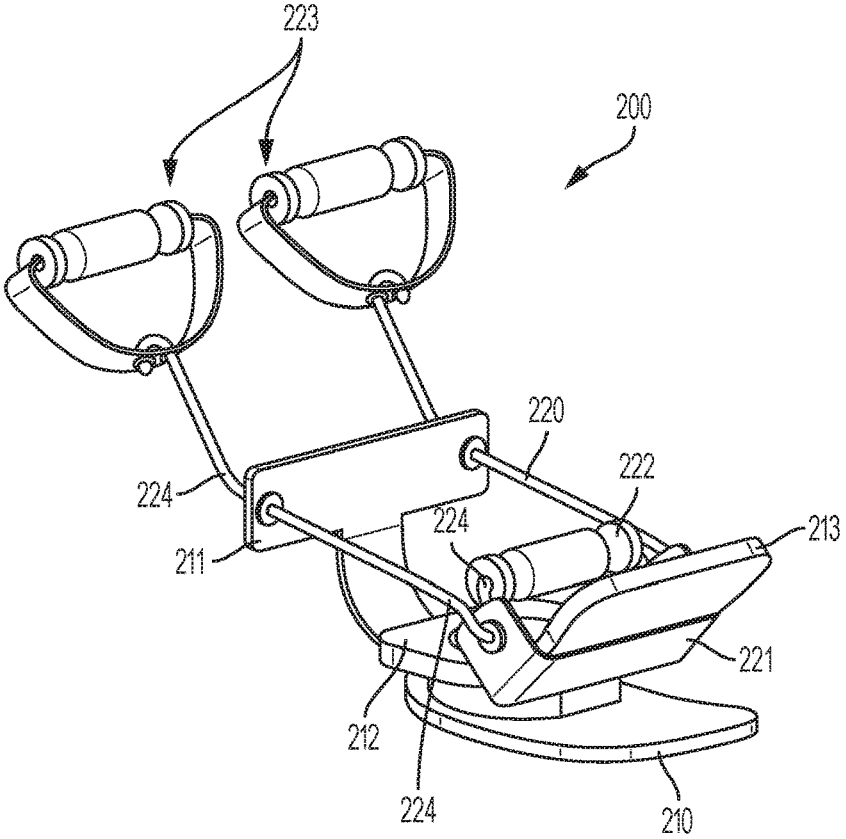
FIG. 6 is a side perspective view of a portable lower limb therapy device built in accordance with a back handle embodiment of the present invention with a platform member in a partially flexed configuration.
Figure 7:
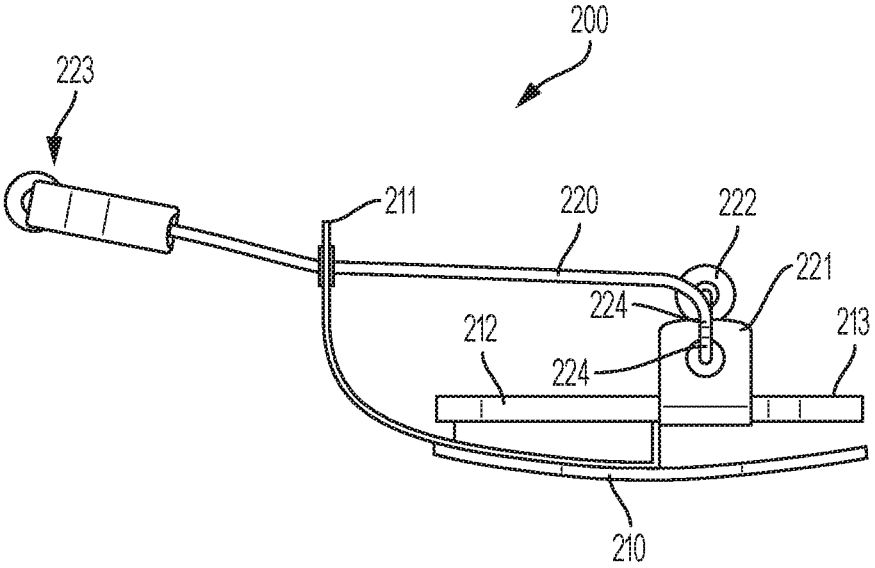
FIG. 7 is a side elevational view of a portable lower limb therapy device built in accordance with a back handle embodiment of the present invention with a platform member in a relaxed configuration.
Figure 8:
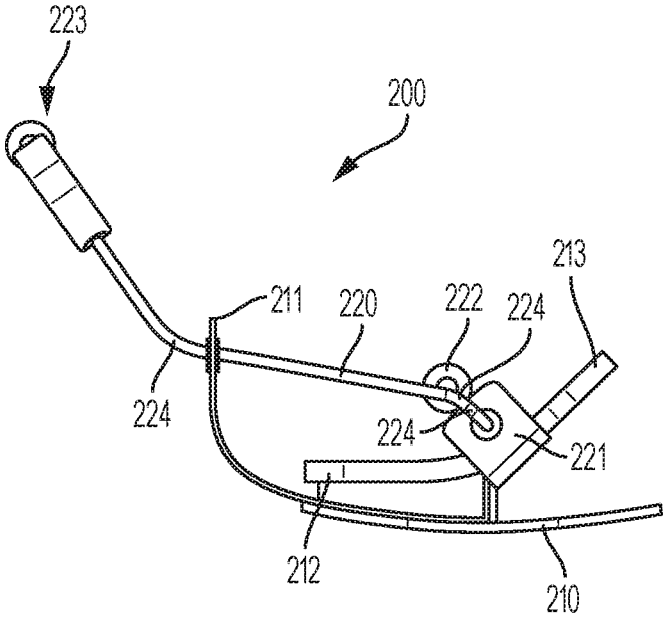
FIG. 8 is a side elevational view of a portable lower limb therapy device built in accordance with a back handle embodiment of the present invention with a platform member in a partially flexed configuration.
Figure 9:
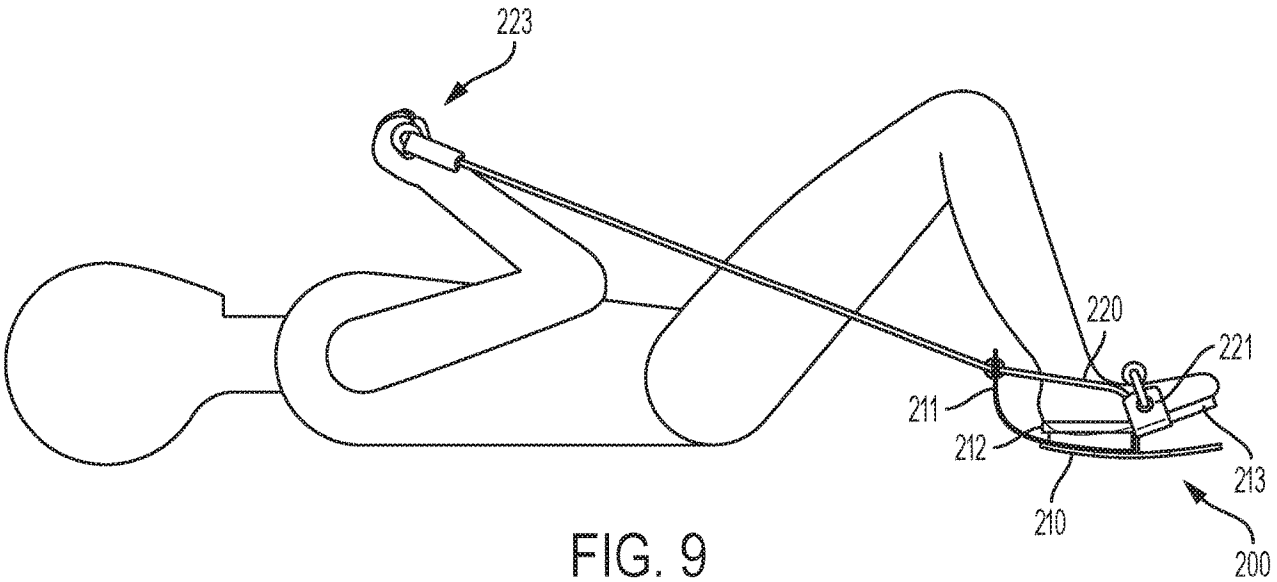
FIG. 9 is a side elevational view of a portable lower limb therapy device built in accordance with a back handle embodiment of the present invention with a platform member in a partially flexed configuration, shown with a patient's foot in place therein.
Figure 10:
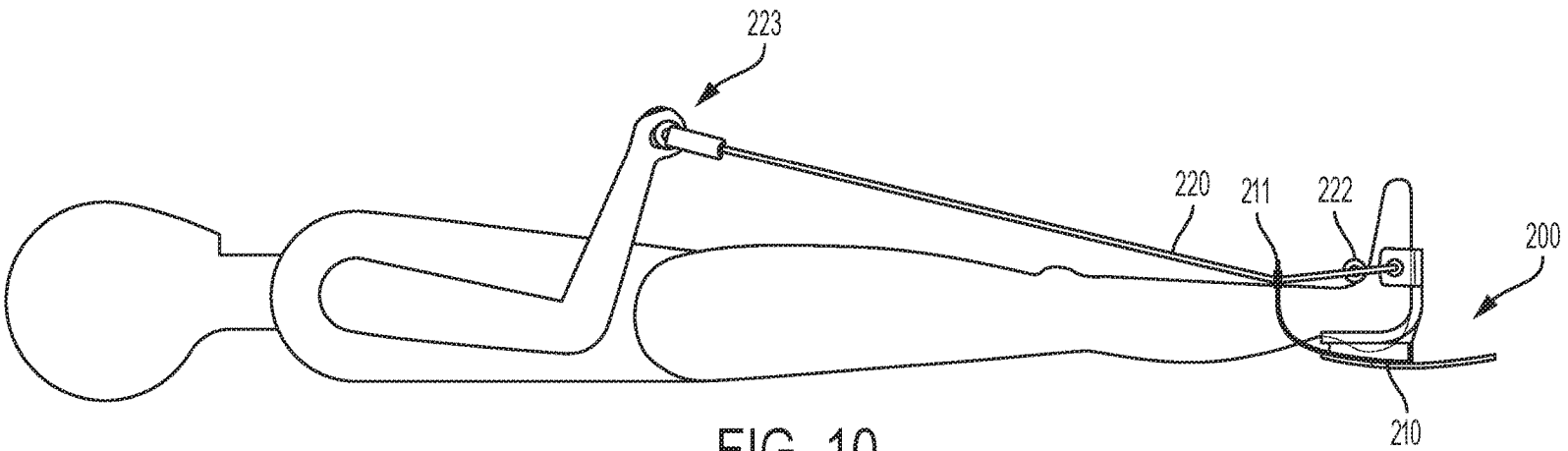
FIG. 10 is a side elevational view of a portable lower limb therapy device built in accordance with a back handle embodiment of the present invention with a platform member in a fully flexed configuration, shown with a patient's foot in placed therein.

The distal portion 212*b* forms the front edge of the platform member 212 and is movable relative to the platform member 212 so as to be able to flex between an elevated position relative to the platform member 212, as illustrated in FIGS. 2, 4, and 6, and a planar position relative to the platform member 212, as illustrated in FIGS. 1, 3, and 5. It is appreciated that the distal portion 212*b* being in the elevated position, sitting diagonally relative to the platform member 212, defines the flexed configuration of the platform member 212 while the distal portion 212*b* being in the planar position, sitting in horizontal alignment with the platform member 212, defines the relaxed configuration of the platform member 212. It is further appreciated that the distal portion 212*b* being in the elevated position enables the placement of a foot of a user in a diagonal position relative to the platform member 212 with the heel of the foot resting in the central aperture and the foot extending up therefrom onto the diagonally oriented distal portion 212*b*, as illustrated in FIG. 6.

It is contemplated that the platform member 212, including the distal portion 212*b*, may be formed of a single, unitary structure that constructed of a flexible material so as to allow for the platform member 212 to bend. In alternative embodiments, the platform member 212 may include a flexible transverse portion that allows the platform member 212 to bend or the platform member 212 may be formed from two discrete structures connected by a hinge joint.

It is contemplated that the distal portion 212*b* being wider than the rest of the platform member 212 may configure the distal portion 212*b* to receive and support portions of a user's foot having a greater width than the heel.

The slider 210 and heel panel 211 may be constructed of hard plastic and the platform member 212 may be constructed out of a substantially firm foam that can still bend when subjected to manual force in the manner described below.

The pulley system defines a closed force transfer system, arranged with the cord member 220 extending from the rear handle 223 on the right side of the portable lower limb therapy device 200, through an aperture in the heel panel 211 positioned on the right side thereof, then through an aperture in the support member 221 positioned on the right side thereof, then through the cross member 222 entering on the right side and exiting on the left side of the portable lower limb therapy device 200, then through an aperture in the support member 221 positioned on the left side thereof, through an aperture in the heel panel 211 positioned on the left side thereof and finally connecting to the rear handle 223 on the left side.

The handles 223 are each positioned behind the heel panel 211, and may be constructed of or otherwise include foam. The handles 223 may be defined by a substantially cylindrical handle portion with a foam surface and a web type strap, with the web type strap connecting to the cord member 220 and to the handle portion to improve durability without sacrificing comfort.

The support member 221 defines a mechanical connector integrated with the platform member 212, with a connection portion positioned on the right side of the platform member 212 and a connection portion positioned on the left side of the platform member 212. Each connection portion may include an aperture therein so as to configure it to allow the cord member 220 to pass through it. In addition, the support member 221 may be positioned further from the forward edge of the platform member 212 than the distal portion 212*b*.

The support member 221 may define a molded or web type strap that is attached to the bottom of the platform member 212, with a portion extending beyond the platform member 212 on both the right and left side so as to form the connection portions. The connection portions may include grommets integrated with the apertures therein. In an alternate embodiment, the support member 221 may be defined solely by two connection portions extending from either side of the platform member 212.

The cross member 222 is positioned sufficiently above the platform member 212 to allow the foot of a user that is resting on the platform member 212 to slide underneath the cross member 222. The cross member 222 may be defined by a substantially cylindrical handle portion with a foam surface. The cross member 222 may be positioned directly above the support member 221 such that the cord member 220 travels vertically from the support member 221 on either side of the cross member 222 into the cross member 222 (when the platform member 212 is in the planar position).

Notably, because the cord member 220 extends from the rear handle 223 on each side of the, to and through the support member 221 on either side of the platform member 212, the pulley system is configured to transfer force applied behind the heel panel 211 to the platform member 212. Similarly, because the cord member 220 connects on either end to one of the handles 223, passes through the support member 221 on either side of the platform member 212, and passes through the cross member 222, the pulley system is configured to transfer force applied above a user's foot positioned on top of the platform member 212 to the platform member 212.

The pulley system may also include a plurality of rigid shafts 224 through which the cord member 220 passes. It is contemplated that the rigid shafts 224 may operate to hold the cord member 220 in position as it passes from one pulley system structure (i.e., heel panel 211, support member 221, cross member 222) to the next and limit how close different pulley system structures can get to one another.

The cord member 220 may define an elongated, continuous line that may be constructed of a rope, strap, tubing, or cable. The cord member may be of an elastic material or a rigid material. In an alternate embodiment, however, the cord member 220 may be a plurality of cord members attached to the rigid shafts 224.

The heel panel 211 may include grommets integral with the apertures through which the cord member 220 passes.

It is contemplated that a user having their foot positioned in the may exert mechanical force on the lower limb therapy device 200 with their upper body (as passive motion) by grabbing either the handles 223 or the cross member 222. In this regard, the lower limb therapy device 200 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 200 is not on a track and can move in any direction, circumduction an available therapy motion option). Indeed, the pulley system enables a user to control the motion and the speed at which the lower limb moves as it is being flexed and extended thru various planes.

Moreover, because of the slider 210 can move on substantially any type of smooth surface, the lower limb therapy device 200 provides a means to support the weight of a user's lower limb and allow the limb to slide and glide even on uneven surfaces as a bed or therapy table.

It is appreciated that in addition to being used for rehabilitation related purposes, the portable lower limb therapy device in accordance with either embodiment can also be used by a user or patient that has limited ability to move or no ability to move their lower limbs (such as someone that is paralyzed from the waist down). For such a user, the portable lower limb therapy device can allow the user to stretch and work the muscles in a leg and/or foot by placing the targeted foot (or foot of the targeted leg) in the portable lower limb therapy device and using force applied solely from the user's arms to lift and position the leg in a manner that causes the muscles in the target foot and/or leg to stretch or otherwise be worked (particularly because the user can move the leg and any direction). Advantageously, such an act can allow the user to improve blood flow in the lower limb and otherwise better maintain the health of the lower limb.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable lower limb therapy device, comprising:

a support base having a pad positioned above a slider, wherein the pad is operative to support a foot of a user that is resting on the pad and the slider includes a smooth bottom surface which enables the support base to slide on a smooth surface;

wherein the support base includes a proximal edge and a distal edge;

a pulley system defined by a closed force transfer system integral with the support base, wherein the pulley system includes at least one cord member; and wherein the at least one cord member is coupled to the support base at a first location adjacent to the distal edge and a second location that is adjacent to the proximal edge, with the at least one cord member adapted to extend first from the first location to the second location and then from the second location outwardly from the support base.

2. The portable lower limb therapy device of claim 1, wherein said support base includes a heel panel extending up from the slider at a location adjacent to the proximal edge, with the second location integral with the heel panel.

3. The portable lower limb therapy device of claim 2, wherein said heel panel includes a surface that is on a plane which is orthogonal to the smooth bottom surface.

4. The portable lower limb therapy device of claim 1, wherein said slider includes a slight curve.

5. The portable lower limb therapy device of claim 1, wherein:

the pulley system additionally includes at least one handle coupled with an end of the at least one cord member that is adapted to extend outwardly from the support base;

the at least one cord member is operative to transfer mechanical force applied behind the support base through the at least one handle to support base at both the first location and the second location.

6. The portable lower limb therapy device of claim 1, wherein the pulley system includes a cross member positioned above the pad in a location that is between the proximal edge and the distal edge of the support base.

7. The portable lower limb therapy device of claim 6, wherein:

the cross member is adapted to receive an application of mechanical force and the at least one cord member passes through the cross member; and the at least one cord member is operative to transfer mechanical force applied above the support base through the cross member to support base at both the first location and the second location.

8. A portable lower limb therapy device, comprising:

a support base having a pad positioned above a slider, wherein the pad is operative to support a foot of a user that is resting on the pad and the slider includes a smooth bottom surface which enables the support base to slide on a smooth surface;

wherein the support base includes a proximal edge and a distal edge;

a pulley system defined by a closed force transfer system integral with the support base, wherein the pulley system includes at least one cord member; and wherein the at least one cord member is coupled to the support base at a first location adjacent to the distal edge and at a second location adjacent to the proximal edge, with the at least one cord member (1) adapted to extend first from the first location to the second location and then from the second location outwardly from the support base, (2) operative to transfer mechanical force applied to the at least one cord member behind the support base to support base at both the first location and the second location, and (3) operative to transfer mechanical force applied to the at least one cord member above the support base to support base at both the first location and the second location.

9. The portable lower limb therapy device of claim 8, wherein:

said support base includes a heel panel that extends up from the slider at a location adjacent to the proximal edge and that includes a surface that is on a plane which is orthogonal to the smooth bottom surface; and the second location is integral with the heel panel.

10. The portable lower limb therapy device of claim 9, wherein slider includes a slight curve.

11. The portable lower limb therapy device of claim 10, wherein:

the pulley system additionally includes at least one handle coupled with an end of the at least one cord member that is adapted to extend outwardly from the support base; and the at least one cord member is operative to transfer mechanical force applied behind the support base through the at least one handle to support base.

12. The portable lower limb therapy device of claim 11, wherein the pulley system includes a cross member positioned above the pad in a location that is between the proximal edge and the distal edge of the support base.

13. The portable lower limb therapy device of claim 12, wherein:

the cross member is adapted to receive an application of mechanical force and the at least one cord member passes through the cross member; and the at least one cord member is operative to transfer mechanical force applied above the support base through the cross member to support base at both the first location and the second location.

14. The portable lower limb therapy device of claim 8, wherein:

the pulley system additionally includes at least one handle coupled with an end of the at least one cord member that is adapted to extend outwardly from the support base; and the at least one cord member is operative to transfer mechanical force applied behind the support base through the at least one handle to support base.

15. The portable lower limb therapy device of claim 14, wherein:

the pulley system includes a cross member positioned above the pad in a location that is between the proximal edge and the distal edge of the support base the cross member is adapted to receive an application of mechanical force and the at least one cord member passes through the cross member; and the at least one cord member is operative to transfer mechanical force applied above the support base through the cross member to support base at both the first location and the second location.

16. The portable lower limb therapy device of claim 8, wherein:

the pulley system includes a cross member positioned above the pad in a location that is between the proximal edge and the distal edge of the support base the cross member is adapted to receive an application of mechanical force and the at least one cord member passes through the cross member; and the at least one cord member is operative to transfer mechanical force applied above the support base through the cross member to support base at both the first location and the second location.

* * * * *